US005956775A

United States Patent [19]

Ezra

[11] Patent Number: 5,956,775

[45] Date of Patent: Sep. 28, 1999

[54] COMBINATION JEANS AND METALLIC ORNAMENT

[76] Inventor: Rami Ezra, 535 W. 36th St., Suite 1106, New York, N.Y. 10018

[21] Appl. No.: 08/722,637

[22] Filed: Sep. 27, 1996

[51] Int. Cl.[6] ..... A41D 27/00; A41D 27/08

[52] U.S. Cl. ..... 2/227; 2/79; 2/244

[58] Field of Search ..... 2/1, 47.48, 49.1, 2/49.2, 49.3, 49.4, 49.5, 50, 51, 52, 75, 80, 83, 94, 108, 113, 114, 115, 105, 106, 160, 247, 227, 79, 244, 245, 246; 40/586

[56] References Cited

U.S. PATENT DOCUMENTS

| | | | |
|---|---|---|---|
| 247,129 | 9/1881 | Starkey | 2/246 |
| 296,636 | 4/1884 | Smith | 2/244 |
| 1,323,977 | 12/1919 | Gaunt | 2/246 |
| 2,517,376 | 8/1950 | Artzt et al. | 40/20 |
| 3,782,017 | 1/1974 | Graham | 40/300 |
| 3,829,995 | 8/1974 | Fakoury | 40/16 |
| 4,513,454 | 4/1985 | Anderson et al. | 2/246 |
| 4,667,274 | 5/1987 | Daniel | 2/209.2 X |
| 4,975,987 | 12/1990 | Teachout et al. | 2/246 |
| 5,276,985 | 1/1994 | Halloran | 40/329 |

*Primary Examiner*—Jeanette E. Chapman
*Attorney, Agent, or Firm*—Longacre & White

[57] ABSTRACT

A combination pair of jeans and a metallic ornamentation. A substantially rectangular metallic ornament is affixed to a rear portion of a waistband of a pair of conventional jeans in place of the conventional leather label. The metallic ornament may be rivetted to the waist band or it may be adhered to a leather strip which is in turn sewn onto the waistband. A plurality of metallic belt loops may also be provided and attached to the waistband in a similar fashion. The metallic ornament is made of a lustrous material providing an enhanced appearance. The metallic ornament may be engraved with a specific pattern, logo or other text. The metallic ornament may also be formed of a metal anodized to a specific color.

6 Claims, 3 Drawing Sheets

COMBINATION JEANS AND METALLIC ORNAMENT

BACKGROUND OF THE INVENTION

1. Field of the Invention

This invention pertains to wearing apparel, and more particularly to a combination of jeans and metallic ornamentation.

2. Description of the Prior Art

Jeans are well known in the art. However, the conventional jeans lack the ornamentation and accessories necessary in today's fashion industry. While the application of labels to a rear section of a waist portion of a pair of jeans is well known in the art, these labels are usually made of thin leather sewn onto the material of the jeans. However, leather is a lackluster material which fades with continued washing. Furthermore, leather labels usually wear out with continued washing and wear to the extent that they peel, crack and disintegrate. Once the label has worn away, an unfaded portion of the jeans is exposed resulting in an unpleasant appearance.

Belt loops are usually made of the same material as the jeans. These conventional belt loops are sewn onto the waist band of the jeans. Such belt loops blend into the background of the remaining portion of the jeans and wear with continued washing and use. The threads which attach the belt loops to the jeans also wears. After continued wear and use, these belt loops not only fade, but often detach from the jeans resulting in an unpleasant appearance. The need, therefore, exists for a jean design that utilizes a novel arrangement of ornamentation and accessories to satisfy today's fashion-conscious jean wearer.

SUMMARY OF THE INVENTION

The object of the invention is to alleviate the drawbacks of the prior art by providing a metallic ornament which is securely attached to a pair of jeans providing enhanced ornamental features. Alternately a plurality of metallic belt loops are secured to the waist portion of a pair of jeans.

In accordance with the present invention a pair of conventional jeans is provided with metallic ornamentation. This metallic ornamentation is preferably in the form of a rectangular sterling silver or silver-plated label rivetted onto the rear section of a waistband of a pair of jeans. The ornament may be riveted to the jeans in such a fashion that the rivet remains unexposed or exposed to the outside of the jeans. Metallic belt loops are also provided which are also riveted to the waist portion of the jeans.

DETAILED DESCRIPTION OF THE PREFERRED EMBODIMENT

Figure 1:
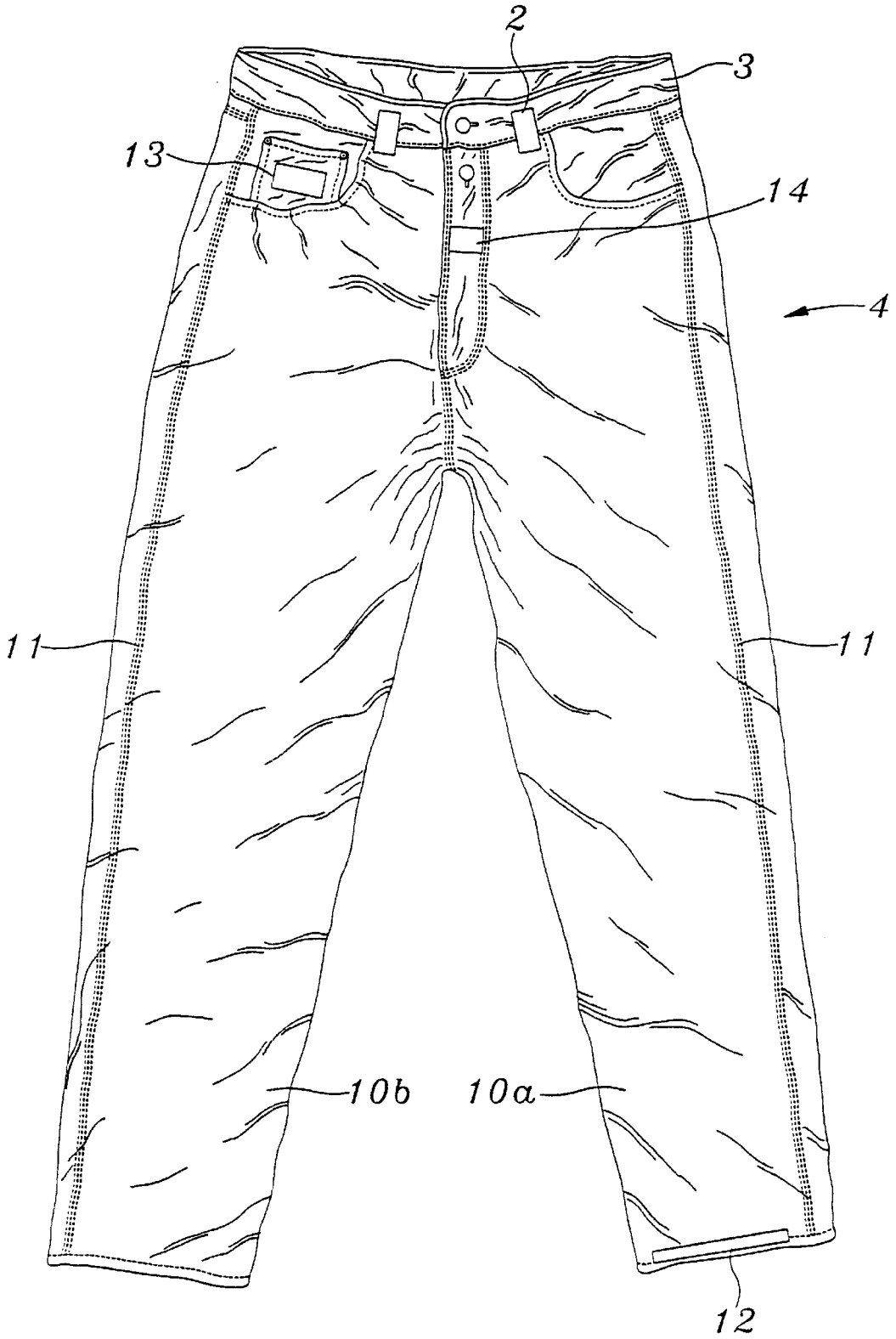
FIG. 1 represents a front view of a pair of jeans with a pair of metallic belt loops according to the present invention.
Figure 2:
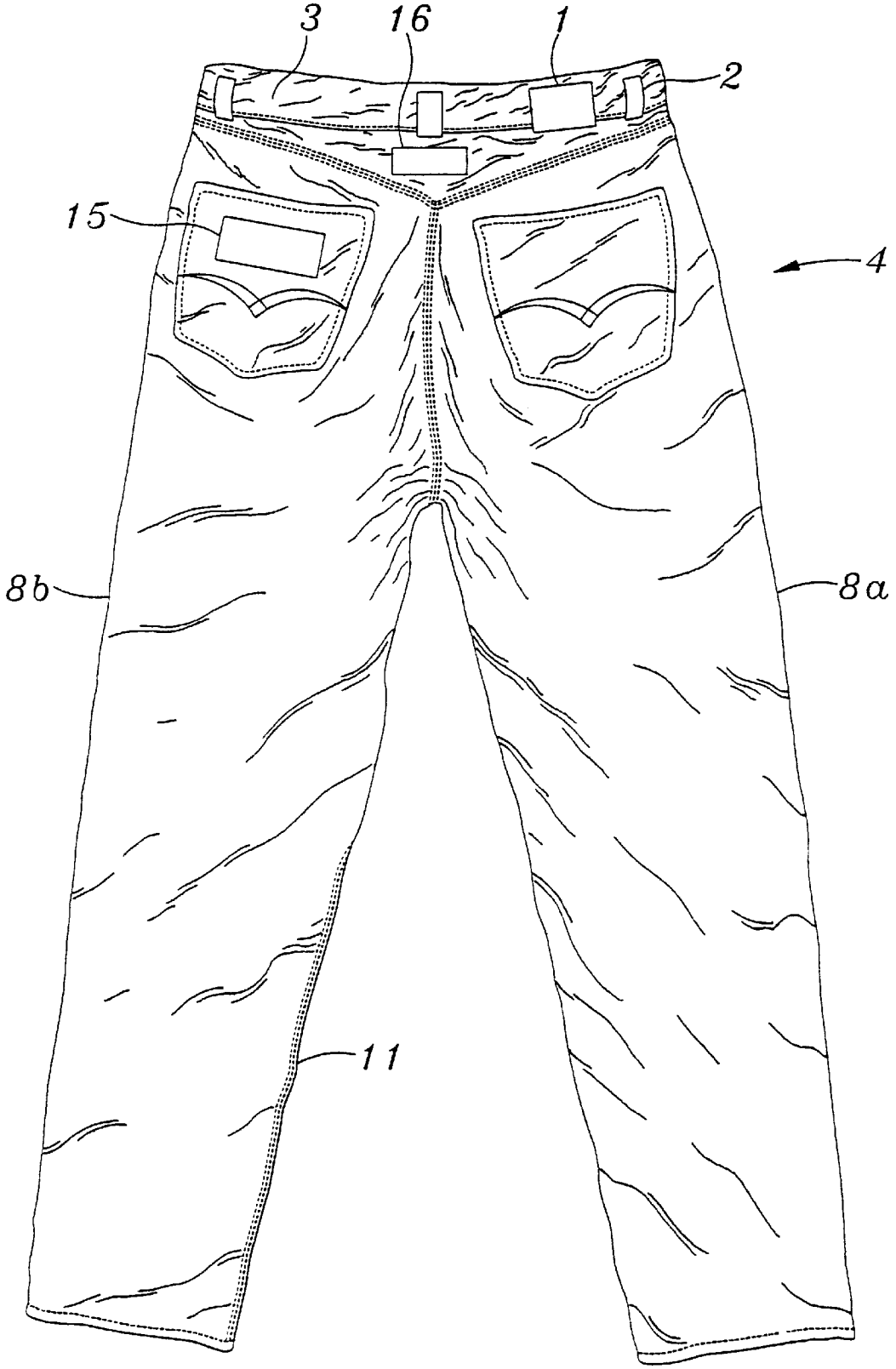
FIG. 2 represents a rear view of the jeans depicted in FIG. 1 with a metallic ornament and belt loops according to the present invention.

FIGS. 1 and 2 illustrate a combination pair of jeans and a metallic ornament according to the present invention. A conventional pair of jeans 4 is provided with a substantial rectangular metallic ornament 1. The conventional jeans comprise a pair of front and rear leg portions 10*a*, 10*b* and 8*a*, 8*b* respectively. The leg portions are sewed together along stitch lines 11 to enclose the legs and hips of a person. A waistband 3 is provided to enclose a person's waist and is attached to the leg portions to form a conventional pair of jeans.

The metallic ornament 1 is preferably made of silver or a silver plated material. However, other lustrous metals may be used to form the metallic ornament 1. Specifically, stainless steel may be chosen for its lustrous and mirror like appearance which also has corrosion resistant properties. The exposed surface of the metallic ornament may be engraved with a logo, text, or other specific patterns. Such engraving provides a long lasting image which will not fade with continued washing.

Alternately, the metallic ornament may be formed of a metal which is anodized to a specific color. By choosing a particular metal and anodization process, a metallic ornament of aspecific color may be produced. One such color is electric blue.

Metallic belt loops 2 may be provided on the pair of jeans 8. The belt loops can be fashioned similar to the metallic ornament but sized to accommodate a belt. FIG. 1 represents a front view of a combination pair of jeans and metallic ornament comprising a plurality of metallic belt loops 2. The choice of material for the belt loops 2 is preferably the same as that of the metallic ornament. However, different material may be used to provide various looks.

Figure 3:
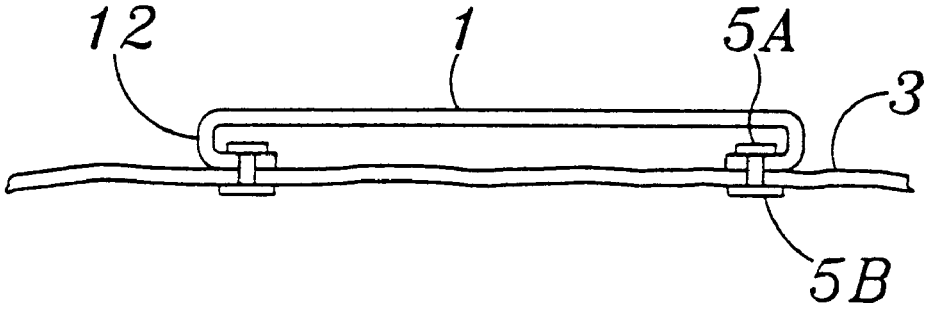
FIG. 3 represents a sectional view of the metallic ornament attached to a waist portion of a pair of jeans according to the preferred embodiment of the present invention.
Figure 4:
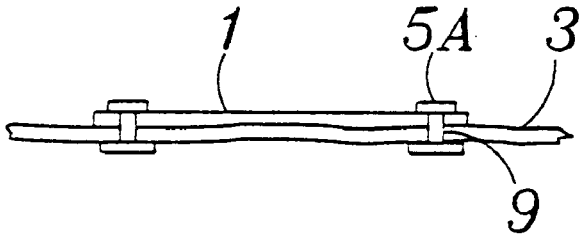
FIG. 4 represents a sectional view of a metallic ornament attached to the waist portion of a pair of jeans according to an alternate embodiment of the present invention.

FIG. 3 represents a metallic ornament 1 secured to a portion of the waistband 3. The metallic ornament 1 has a pair of inturned flange portions 12. These flange portions have a bore adapted to receive and intermediate portion 9 of a rivet. A widened end 5*a* of the rivet is disposed between an inner surface of the metallic ornament and the inturned flange portion 12. This arrangement covers the rivets to provide a clean and smooth appearance of the metallic ornament. Alternately, the metallic ornament may be directly riveted to the waistband 3 as shown in FIG. 4.

Figure 5:
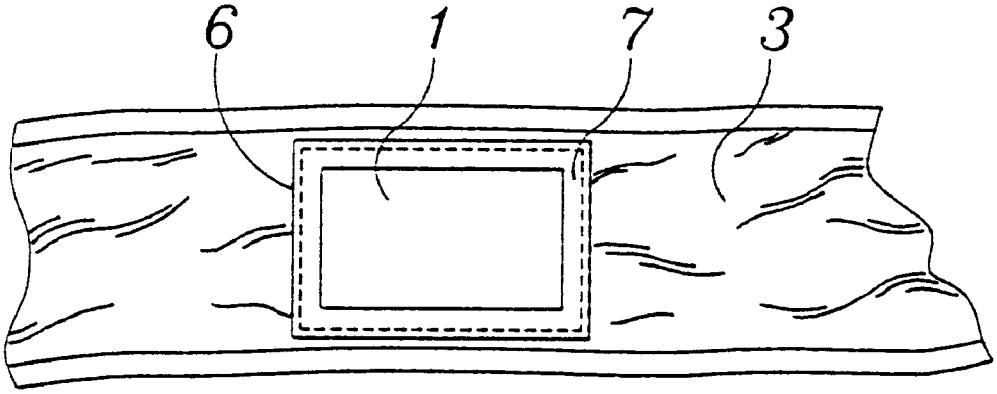
FIG. 5 represents a plan view of a metallic ornament attached to the waist portion of a pair of jeans according to an alternate embodiment of the present invention.

FIG. 5 represents an alternate means to secured the metallic ornament 1 to the waist band 3. Metallic ornament 1 is rivetted, adhered or otherwise attached to a leather strip 6. The leather strip 6 is in turn sewn to the waist band 3 along thread lines 7. Preferably, the leather strip 6 has a shape substantially similar to that of the metallic ornament 1 and is uniformly oversized to provide a portion to be sewn onto the waist portion 3 of the pair of jeans. The metallic ornament 1 prefereably has planar dimension substantially equal to a 2" by 3" rectangle. Alternately, the metallic ornament 1 may be riveted to the leather strip as demonstrated in either of FIGS. 3 or 4.

The choice of a metallic material for the ornament is critical. The choice of a metallic material affords a strong rigid material from which to form an ornamental design. The metallic ornament will resist fading over prolonged washing. Additionally, a lustrous material will present a shiny and distinct appearance which is desirable to a wide-ranging market.

Metallic belt loops 2 are shown in FIGS. 1 and 2. These belt loops may be secured to the waist band 3 of the pair of jeans in the same manner which the metallic ornament 1 is fashioned. It is preferred to secure the metallic belt loops to the waistband 3 in the same manner as the metallic ornament is secured as shown in FIG. 3. The space between an inner surface of the metallic piece and the waist band 3 provides a space to receive a belt.

The use of a metallic ornament affixed to a conventional pair of jeans provides a corrosion resistant, and wear resistant surface from which to form a logo, text or other pattern. Additionally, the lustrous metallic portion will afford a distinct appearance which is attractive to numerous markets.

While the foregoing invention has been shown and described with reference to a number of preferred embodiments, it will be under by those possessing skill in the art that various changes and modification may be made without departing from the spirit and scope of the invention. For example, these include metallic ornaments placed along a pant seam 12, on the front inside pocket 13, on zipper panel 14, on a rear pocket 15, or on any other portion of the jeans such as on a rear panel 16.

I claim:

1. A combination pair of jeans and metallic ornament said combination comprising:

a pair of jeans having two front leg portions and two back leg portions each extending from a waist end to a lower end, said front and back leg portions being joined to each other to enclose a persons legs and hips, said pair of jeans including a waist portion joined to said waist end of said front and back leg portions adapted to enclosed said hips;

a substantially rectangular metallic ornament secured to a rear portion of said waist portion of said pair of jeans; and a plurality of rivets having a first and second end and an intermediate portion;

wherein, said metallic ornament includes a pair of inturned flange portions disposed on opposite ends thereof, each of said inturned flange portions including at least one bore adapted to receive said intermediate portion of one of said rivets, said first end of said rivet being disposed between an inner surface of said metallic ornament and said inturned flange portion, said metallic ornament being riveted to said waist portion of said pair of jeans.

2. A combination pair of jeans and metallic ornament said combination comprising:

a pair of jeans having two front leg portions and two back leg portions each extending from a waist end to a lower end, said front and back leg portions being joined to each other to enclose a persons legs and hips, said pair of jeans including a waist portion joined to said waist end of said front and back leg portions adapted to enclosed said hips;

a substantially rectangular metallic ornament secured to a rear portion of said waist portion of said pair of jeans; and a substantially rectangular leather strip; wherein, said metallic ornament is secured to said leather strip and said leather strip is sewn onto said waist portion of said pair of jeans.

3. The combination pair of jeans and metallic ornament according to claim 2, wherein said leather strip has a shape substantially similar and uniformly oversized with respect to said metallic ornament to provide an exposed portion to be sewn to said waist portion of said pair of jeans.

4. The combination pair of jeans and metallic ornament according to claim 3, wherein, said metallic ornament has a planar dimension substantially equal to a 2"by 4" rectangle.

5. A combination pair of jeans and metallic ornament said combination comprising:

a pair of jeans having two front leg portions and two back leg portions each extending from a waist end to a lower end, said front and back leg portions being joined to each other to enclose a persons legs and hips, said pair of jeans including a waist portion joined to said waist end of said front and back leg portions adapted to enclosed said hips;

a substantially rectangular metallic ornament secured to a rear portion of said waist portion of said pair of jeans; and a plurality of rivets;

wherein, said metallic ornament includes a plurality of bores adapted to receive a portion of said rivet, said metallic ornament being secured to said waist portion of said pair of jeans by one of said plurality of rivets and said metallic belt loop includes a pair of inturned flange portions disposed on opposite ends thereof, each of said inturned flange portions includes at least one bore adapted to receive one of said plurality of rivets, said metallic belt loop being riveted to said waist portion of said pair of jeans.

6. A combination pair of jeans and metallic ornament said combination comprising:

a pair of jeans having two front leg portions and two back leg portions each extending from a waist end to a lower end, said front and back leg portions being joined to each other to enclose a persons legs and hips, said pair of jeans including a waist portion joined to said waist end of said front and back leg portions adapted to enclosed said hips;

a substantially rectangular metallic ornament secured to a rear portion of said waist portion of said pair of jeans; and a plurality of metallic belt loops secured to said waist portion of said jeans, said belt loops adapted to receive and retain a belt to secure said waist portion about said person's hips.

* * * * *